US006740356B2

(12) United States Patent
Bindschedler et al.

(10) Patent No.: US 6,740,356 B2
(45) Date of Patent: May 25, 2004

(54) PROCESS FOR THE PRODUCTION OF A BITUMINOUS SEALING SHEET

(75) Inventors: Pierre Etienne Bindschedler, Obernai (FR); Hervé Fellmann, Bischoffsheim (FR); Rémi Perrin, Molsheim (FR)

(73) Assignee: Soprema (Societe Anonyme), Strasbourg (FR)

( * ) Notice: Subject to any disclaimer, the term of this patent is extended or adjusted under 35 U.S.C. 154(b) by 0 days.

(21) Appl. No.: 09/983,785

(22) Filed: Oct. 25, 2001

(65) Prior Publication Data

US 2002/0048651 A1 Apr. 25, 2002

(30) Foreign Application Priority Data

Oct. 25, 2000 (FR) ..... 00 13688

(51) Int. Cl.[7] ..... B05D 1/36; B05D 1/38; B05D 3/12; B05D 5/10

(52) U.S. Cl. ..... 427/210; 427/264; 427/275; 427/356; 427/443

(58) Field of Search ..... 427/207.1, 208, 427/209, 210, 211, 256, 258, 270, 271, 277, 293, 355, 356, 443; 428/141, 156; 442/48; 52/746.11, DIG. 16

(56) References Cited

U.S. PATENT DOCUMENTS 1,802,032 A * 4/1931 Overbury ..... 427/187
2,559,879 A * 7/1951 Kalin ..... 427/187
4,795,661 A * 1/1989 Bondoc et al. ..... 427/187
6,360,506 B1 * 3/2002 Graae ..... 52/408

FOREIGN PATENT DOCUMENTS

| | | | |
|---|---|---|---|
| CA | 2257455 A1 | * | 7/1997 |
| DE | 89 04 333.2 | | 7/1989 |
| DE | 296 13 310 U1 | | 1/1998 |
| DE | 299 11 125 U1 | | 2/2000 |
| DE | 199 09 483 A1 | | 4/2000 |
| EP | 0 905 303 A2 | | 3/1999 |
| WO | WO 00/46462 | | 8/2000 |

* cited by examiner

*Primary Examiner*—Shrive P. Beck
*Assistant Examiner*—William Phillip Fletcher, III
(74) *Attorney, Agent, or Firm*—Young & Thompson

(57) ABSTRACT

A process and an installation for the production of a bituminous sealing sheet, comprises a strip impregnated and/or coated with a given bitumen and having a zone in the shape or a band or a portion of a band of a different bitumen from the first bitumen. A strip (2) is produced which is impregnated and/or coated except for at least one zone in the form of a strip or a strip portion (4) on at least one of its surfaces (2', 2"), having a thinner thickness of bitumen (3, 3') or no application of bitumen (3, 3'), to be used at the at least one strip or strip portion (4), over a controlled thickness, a different bitumen (5) from that initially applied and finally, after cooling and solidification of the eventually added bitumen (5), processing the resulting sheet or sealed membrane (11) 5 in the desired form, the processing operations being carried out by continuous movement of the strip (2) in an installation (6) or suitable coating line comprising at least two coating stations (7, 7', 8).

14 Claims, 2 Drawing Sheets

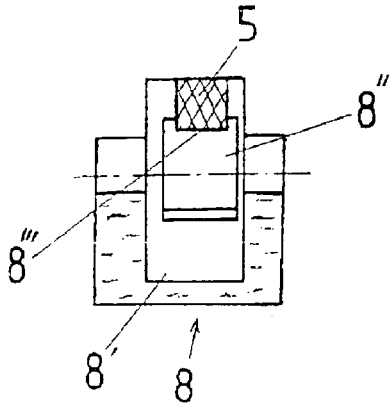
Fig. 2
Fig. 3A
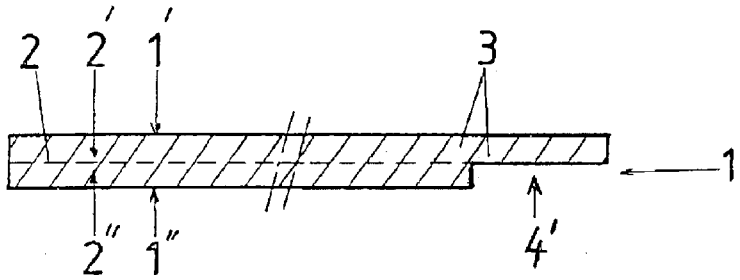
Fig. 3B
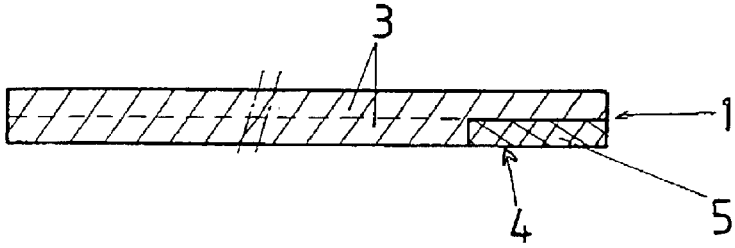
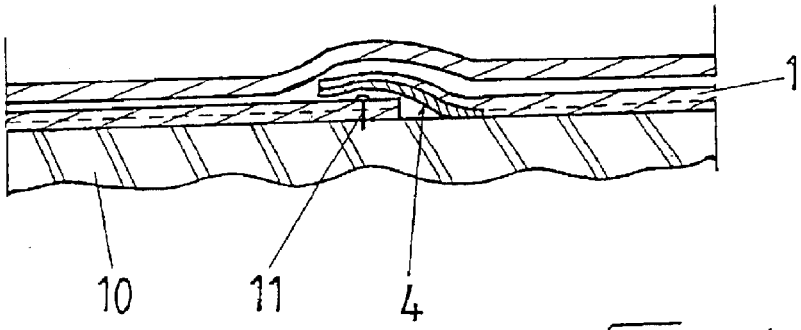
Fig. 4

PROCESS FOR THE PRODUCTION OF A BITUMINOUS SEALING SHEET

FIELD OF THE INVENTION

The present application corresponds to French application Serial No. 00 13688 filed Oct. 25, 2000, the disclosure of which is incorporated herein by reference.

The present invention relates to the field of bituminous sealing products, and has for its object a process for the production of a bituminous sealing sheet or membrane, an installation for practicing the process, a sheet or membrane obtained by this process, as well as a sealing system for roofs comprising such sheets or membranes.

BACKGROUND OF THE INVENTION

The present bituminous sheets or membranes are generally produced by drawing a coating support (for example a fibrous or filamentary armature) through a coating line comprising at least one, and preferably several, coating stations each formed with a vat containing bitumen or a mixture or a composition based on bitumen in liquid form, in which is immersed a rotatable printing or coating roller over which said armature passes lengthwise.

Each coating roller thus applies a layer of bitumen on the underside of the armature whilst liquid bitumen is also poured on the upper surface by means of vats or pouring lips, the bitumen being immediately after application and before cooling forcibly impregnated into the armature by means for example of two opposite calender rolls determining the thickness of the layers of bitumen by scraping off the surplus and leaving the surfaces of said armature impregnated and coated.

After cooling and solidification of the layers of bitumen, said impregnated and/or coated armature is cut into segments of predetermined length, forming as many sheets or individual membranes, generally rolled up in rolls for their storage, transport and handling, and unrolled at the work site before their installation.

These bituminous sheets are applied to supports to be covered and laterally welded to each other by heating of their undersurfaces with a torch to render the corresponding layer of bitumen fluid.

However, this mode of securement is troublesome in the presence of a flame at a work site is always an important risk factor.

Moreover, numerous supports or constituents to be sealed are more or less flammable or do not resist the heat produced by a torch.

To seek to overcome these drawbacks, there have been proposed sheets and membranes with self-adhesive undersurfaces over all their surface, for example by application of a cold adhesive bitumen. Nevertheless, this surface adherence can give rise to too great and intimate contact between the support and these sheets or membranes, which does not permit distributing tension nor relative movements between them, or even a diffusion of the possible gas pockets present on the undersurfaces.

Moreover, all of the undersurface must be covered by an expensive peelable protective sheet, whose removal can prove to be troublesome at the work site and generate a great deal of waste. Moreover, a good quality of securement can be obtained only during the first attempt at securement, the level of sealing obtained at the overlapping edges between sheets and adjacent membranes that partially overlap in limited regions, not being comparable to that obtained by hot welding and the use of a large quantity of cold self-adherent bitumen, which raises the cost.

To seek to overcome the limitations mentioned above, different improved solutions have been proposed, namely, auto-adhesive sealing sheets having at their edge a thermal weldable strip (see particularly: EP0 352 394), sealing sheets having on their undersurface only spaced strips of self-adhesive bitumen or else sealing sheets fixed mechanically along one of their edges (the opposite edge of the adjacent sheets covering these securements with a thermal weldable strip to ensure sealing).

However, the first and second mentioned solutions imply a return to the use of torches and the second solution gives rise to inequalities of the surface because of the extra thickness at the strips of self-sticking bitumen provided on the undersurface and do not confer sufficient mechanical resistance to tearing apart, because of the small adherent surfaces connected to a securement by simple deposit of said strips of self-adhesive bitumen on the lower layer of bitumen.

A problem faced by the present invention thus consists in providing a process for the production of a sealing sheet or membrane having on at least one of its surfaces at least one strip of bitumen with different properties, without increasing the thickness or with a decreased thickness and having intimate securement with said membrane or sheet.

SUMMARY OF THE INVENTION

To this end, the present invention has for its principal object a process for the production of a bituminous sealing sheet or membrane comprising an armature impregnated and/or coated with at least one bitumen, or at least one bitumen base mixture, provided on at least one of its surfaces and having at least one region in the shape of a strip or portion of a strip of bitumen, or of a bitumen base mixture, different from said bitumen or mixture applied in the first instance, on at least one of its surfaces, which process is characterized in that it consists in producing a strip of armature impregnated and/or coated except for at least one region in the form of a strip or of a portion of a strip on at least one of its surfaces, having a bitumen thickness less than or having no bitumen application, relative to the level of said at least one strip or strip portion, over a controlled thickness, a bitumen or a bitumen base mixture different from that of or those previously applied and, finally, after cooling and solidification or the bitumens or bitumen base mixtures, providing the resulting sealing sheet or membrane in the desired form.

Preferably, all of the operations of treatment mentioned above are carried out in a known manner by continuous lengthwise movement of the armature in a suitable installation or coating line comprising at least two coating stations.

BRIEF DESCRIPTION OF THE DRAWINGS

The invention will be better understood from the following description, which relates to a preferred embodiment, given by way of non-limiting example, and explained with reference to the accompanying schematic drawings, in which:

FIG. 2 is a view in the direction X of a portion of the installations shown in FIG. 1;

FIGS. 3A and 3B are transverse cross-sectional views respectively on the line B—B and C—C, of an embodiment of armature coated by means of the installations shown in FIG. 1, and, FIG. 4 is a side elevational and cross-sectional view of a sealing system comprising particularly sheets obtained by means of the process according to the invention.

DETAILED DESCRIPTION OF THE INVENTION

Figure 1A:
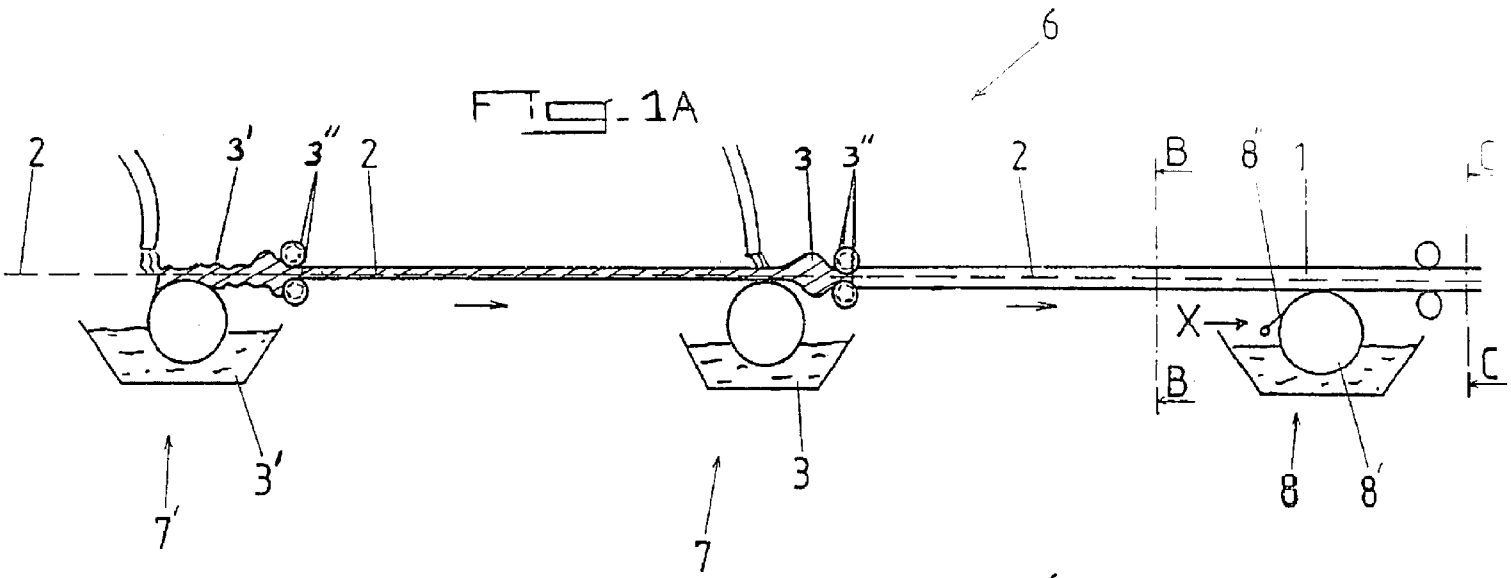
FIGS. 1A and 1B are schematic side elevational views of a coating line or a portion of a coating line for practicing the process according to embodiments of the invention.

The present invention relates essentially to a process for the production of a bituminous sealing sheet or membrane 1 comprising a strip 2 of backing impregnated and/or coated with at least one bitumen, or at least one bitumen base mixture, 3, 3', over at least one of its surfaces 1', 1" and having, on at least one of these surfaces 1', 1", at least one zone 4 in the form of a strip or portion of a strip of bitumen, or a bitumen base mixture 5, different from said bitumen or mixture applied in the first instance at 3, 3'.

According to the invention, and as is shown by way of non-limiting modification in FIGS. 1–3 of the accompanying designs, said process consists in producing a strip 2 of backing impregnated and/or coated substantially uniformly over all its width except at least one zone in the form of a strip or portion of a strip 4 on at least one of its surfaces 2', 2", having a less great thickness of bitumen 3, 3' or having no bitumen 3, 3', relative to the level of said at least one strip or portion of strip 4, over a controlled thickness, a bitumen or a bitumen base mixture 5 different from that or those impregnating and coating the rest of the strip 2 and, finally, after cooling of the bitumen or bitumen base mixture 3, 3', 5, processing the resulting sealing strip or membrane 1 into the desired form.

These treatment operations are preferably carried out by continuous moving of the strip 2 in an installation 6 or suitable coating line comprising at least two coating stations 7 and 8.

The processing will be carried out generally by transversely cutting the continuous strip formed by the strip 2 coated with two or several types of bitumen 3, 3' and 5 into segments of predetermined lengths placed on rollers or presented in the form of flexible plates.

The bitumen or bitumen base mixture 5 eventually applied could have, relative to the initial bitumen or bitumen mixture 3, 3' impregnating and coating the armature 2, a composition and/or different physical, chemical and/or mechanical properties as a function of the particular effects sought in said strip or strips or portion or portions of strip 4 (cold adhesive properties, greater flexibility, increased elongation factor, increased mechanical resistance, higher density, greater rigidity, improved hot strength, . . . ).

The same is true if several layers of bitumen 3, 3' are applied which are compatible with each other, but which could have different mechanical and/or physico-chemical properties.

One could also, as the case may be, apply consecutively several layers of bitumen or mixtures 5, having identical or different formulations.

Nevertheless, according to a preferred embodiment of the invention, the bitumen or bitumen base mixture 5 that is ultimately preferred consists of bitumen or bitumen base mixture that is cold adhesive or self-adhesive, the zone or zones in the form of a strip or strips or portion or portions of a strip 4 receiving said bitumen or auto-adhesive mixture 5 being covered before processing with a peelable protective sheet, for example of the silicone paper type (not shown).

Similarly, the armature 2 that is used, in the form of a strip, could be of various natures and constructions, namely, particularly a non-woven layer or grill of fibers or filament or of polymeric or mineral material, of monolayer structure, multilayer or complex structure (combination of a grill or a layer with a film or a sheet, pierced or continuous, of a metallic, thermoplastic or other material), with single or multiple components, connected or separate, . . .

According to a first embodiment of the invention, shown in FIG. 1A of the accompanying drawings, the application of bitumen or bitumen base mixture 3, 3' is carried out, at least in part, by means of one or several spreaders, particularly of the roller or calender type with a stripper, applying said bitumen or mixture 3, 3' only on a portion or portions of the width of said strip 2.

There will result differences in the thicknesses of the bitumen or mixture 3, 3' that is applied, generating, as a function of the number of zones in the strip or portion of strip 4, a pattern of ribs/grooves or a simple stripping at the level of the surface 2' or 2" in question.

According to a second embodiment of the invention (FIG. 1B), the production of the impregnated and/or coated strip 2 having at least one strip or strip portion 4 without bitumen or with a reduced thickness of bitumen, consists, after coating or impregnating said armature 2 with said at least one bitumen or bitumen base mixture 3, 3', in one or several applications (passage at the level of one or several coating stations 7, 7', applying identical or different bitumens or mixtures), in locally removing, over a pre-regulated width and depth, partially or totally, said at least one bitumen or mixture 3, 3' on at least one of the surfaces 2', 2" of said strip 2, at the level of at least one zone substantially of strip shape or of a portion of a strip 4, for example by scraping or scratching, before cooling and solidification.

Figure 1B:
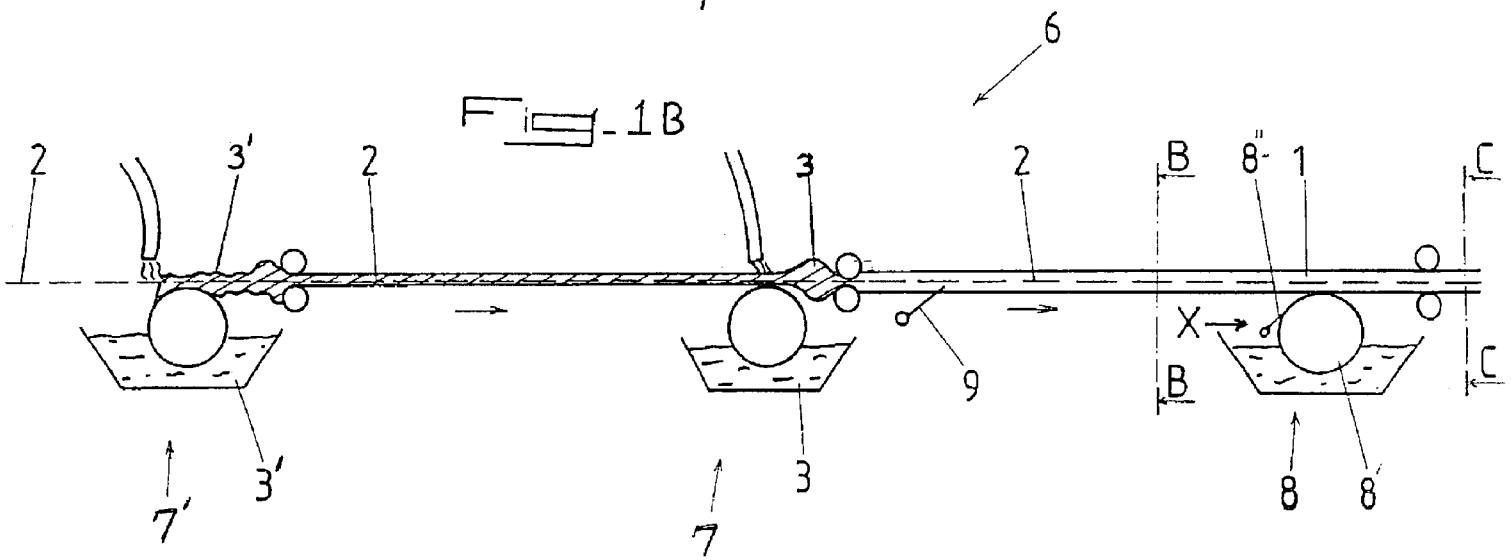

As shown in FIG. 1B of the accompanying drawings, the removal of the bitumen or bitumens or mixture or mixtures based on bitumen 3, 3' initially applied, is carried out by means of a scraper or screed 9 located immediately after the coating station or the last coating station 7 for the initial bitumen or bitumen mixture 3, 3' and pressed against the armature 2 impregnated and coated, moving over or under said scraper or screed 9, this latter bearing if desired directly on said strip 2 used as a scraping support and being preferably adjustable transversely (perpendicular to the direction of movement of the strip 2).

The scraping could if desired remove only a portion of the bitumen or mixture layer 3, 3' on the surface 1 or 1" in question of the sheet or membrane 1.

However, preferably, the scraping will eliminate all of said layer at the level of the zone or zones 4 in question so as to lay bare the corresponding surface 2' or 2" of the strip 2 and to permit an attachment and intimate connection between this latter and the bitumen or bitumen base mixture 5 that is ultimately used in this disengaged zone or zones 4, with the result that there is a mechanical soliderization of high strength, combined with a chemical connection resulting from the nature itself of said bitumen or mixture 5, and an eventual mixture of phases at said bitumen interfaces 3, 3'/5.

As is apparent from the two embodiments described above, the zone or zones 4 can be located in different positions on the sheet or membrane 1, which is to say on the upper surface 1' or the lower surface 1", at the center or on the sides, and can be single or multiple, continuous or segmented, etc. . . .

According to a first modified embodiment, shown in FIG. 3B of the accompanying drawings, the zone 4 receiving the bitumen or bitumen base mixture 5 that is ultimately used consists of a lateral continuous strip forming a longitudinal border of the final resulting sealing sheet or membrane 1 and located on the undersurface or on the lower surface 1" of this latter.

According to a second modified embodiment, not shown in the accompanying drawings, the zone or zones 4 receiving the bitumen or bitumen base mixture 5 that is ultimately used consists in one or several strips extending longitudinally on the undersurface 1" of the sealing membrane or sheet 1, by being, as the case may be, spaced transversely with fixed or variable spacings between them.

Thus, a lower thickness will permit for example using at least one portion of the resulting lower thickness for overlapping at the edges or for the presence of prominent mechanical securement means 11, whilst ensuring an adhering connection that is more intimate in a strip 4 of self-sticking bitumen 5 in contact with the upper surface of an edge of an adjacent sheet.

The invention thus permits controlling perfectly the thickness of the sheet or membrane 1 in the region of the zone or zones 4.

Further to reinforce the connection between the bitumen or bitumen base mixture 5 that is ultimately used and the body of the sheet or membrane 1, particularly the strip 2 of this latter, the process can moreover consist in treating or preparing the bottom 4' of the groove obtained either after local removal of the bitumen or bitumen base mixture 3, 3' initially present, or by failure to apply locally to the latter, this after application of the different layer of bitumen or bitumen base mixture 5 (emplaced with a specific binding agent, removal of a component or treatment of the strip 2, . . . ).

A possible preparation of the bottom 4' of the groove or of the obtained detachment could, for example, consist in applying, after scraping, sand (or a similar granular material) on the surface produced by scraping.

At least a portion of the sand adheres in the bitumen that is not yet solidified on the surface of the bottom of the groove and the excess (unattached) is removed, for example by brushing.

There is thus obtained a granular surface with a high attachment capacity, forming a securement support for the layer or layers of different bitumen 5.

Although described more particularly in relation to one or two bitumens or mixtures 3, 3', those skilled in the art will understand that the bituminous layer or layers used on the surface or surfaces of the armature 2 could also be obtained by successive application of three or more elementary layers of different or identical bitumens or mixtures.

Similarly, the layer of bitumen or mixture 5 could be obtained in one or several applications, and be constituted of several sub-layers of different or identical bitumens or mixtures.

By way of example of a practical non-limiting embodiment of practicing the procedure according to the invention, one can execute the following operations:

- providing a composite polyester-glass fiber armature of 170 g/m$^2$ having a width of one meter;
- impregnating the armature with a fluid bituminous binder;
- surfacing with a bituminous/elastomer binder as needed UEAtc. (obtaining an impregnated membrane of a thickness of about 25 mm);
- scraping the edge of this binder over a width of 8 cm on the undersurface of the impregnated membrane;
- application of a surface type anti-adherent protective film or slate flakes;
- application of an anti-adherent film on the undersurface over the remaining 92 cm of bitumen;
- application, on the 8 cm of scraped bitumen, of a bitumen with self-adhesive properties;
- protection of this auto-adhesive strip by siliconed Kraft paper 10 cm wide.

The present invention also has for its object, as shown in part in FIGS. 1 and 2 of the accompanying drawings, an installation 6 for producing membranes or sheets with bituminous sealing for practicing the second embodiment of the process described above, comprising particularly a bituminous coating line comprising one or several consecutive coating stations 7, 7' through which passes an armature 2 in the form of a continuous strip to be coated, preferably one of the two surfaces, by at least one first bitumen or bitumen base mixture 3, 3', or by first and second bitumens or bitumen mixtures 3 and 3'.

As shown in FIG. 1B of the accompanying drawings, this installation 6 comprises moreover, on the one hand, a scraper or screed 9 disposed immediately after the coating station or the last coating station 7 for said at least one first bitumen or mixture 3 and adapted to remove a pre-adjusted thickness of bitumen or bitumen base mixture 3, 3' present on at least one surface 2" of said armature 2 and at the level of at least one zone 4 in the form of a strip and, on the other hand, a supplemental coating station 8 adapted to apply a layer of bitumen or bitumen base mixture different from the bitumen or mixture 3, 3' scraped from said at least one zone in the form of a strip 4, and located downstream of the latter coating station 7 applying the bitumen or mixture 3, 3' for initial coating and upstream of a further processing station which also is part of said production installation 6.

The scraper 9 could have a given shape, be oriented according to a predetermined direction relative to the passing strip 2 and be applied with a pre-adjusted pressure against this latter, this as a function of the quantity and location of the layer of bitumen or mixture 3, 3' to be removed.

Preferably, this scraper 9 could also be adjusted as to transverse position to permit precise localization of the strip to be scraped.

Alternatively to the use of a scraper or screed 9, there can also be provided according to the invention, as shown in FIG. 1A of the accompanying drawings, that the coating station or stations 7, 7' have grooving or removing calenders 3" applying no or very little bitumen 3, 3' to the band or band portion 4 forming the longitudinal reinforcement adapted to receive the different bitumen or bitumen base mixture 5, said station or stations 7, 7' being followed by a supplemental coating station 8 as described above.

Installation 6 for practicing the invention could be expressly constructed for the production of sheets or membranes 1 or could have a supplemental processing station 8 secured to an existing installation.

However, according to a preferred modified embodiment of the installation according to the invention, a supplemental coating station 8 is movable or mounted retractably or removably and comprises particularly a coater or an inking roller 8' bathed in the different bitumen or bitumen mixture 5, in the liquid condition, for example of the cold self-adhesive bitumen type, and whose surface is scraped away, after impregnation and before application against the strip 2, by a scraper 8" whose shape and dimensions of the cutout 8'" of the front edge is a function of the shape, the arrangement, and the dimensions of the scraped zone or zones 4 and of the thickness of the layer of bitumen or bitumen mixture 5 to be used in said zone or zones 4.

The installation 6 according to the invention could thus be obtained from a conventional coating line, by simple addition of the scraper 9 or by mounting of the detachment calenders 3''' and of the supplemental station 8. By providing this latter as being movable or immovable, it will be possible to modify rapidly the coating line to pass from a conventional production to a production of sheets or membranes 1 according to the invention, or vice versa.

The provision of a strip 4 of cold adhesive bitumen at the longitudinal edge of the sheet or membrane 1, can be carried out by forming a longitudinal strip 4 at a certain distance from the edge of the impregnated and coated armature 2, and then by cutting off a lateral strip to return said strip 4 to the edge of the sheet or membrane 1 (FIG. 3B).

However, according to a preferred modification limiting waste, the scraping and the application of the bitumen layer 5 will take place by micrometric adjustment of the scraper and of the application device at the longitudinal edge of the layer to be coated.

There could also be provided several consecutive assemblies of scraper 9/coating station 8, or a scraper 9 and several consecutive coating stations 8, each station 8 being adapted to apply one or several strips 4 of different bitumen, said strips being distinct and separate or if desired combined (stratified strip formed of several superposed layers of different bitumens).

If desired, one of the stations 8 could also apply a coating product compatible with the bitumen, but of a different nature (for example a polymer or other thermoplastic material).

The present invention also relates, as shown particularly in FIGS. 3 (3A and 3B) of the accompanying drawings, a bituminous sealing sheet or membrane 1 comprising a strip 2 impregnated and/or coated with at least one given bitumen or bitumen base mixture 3, 3', over at least one of its surfaces 1', 1" and having at least one zone 4 in the form of a strip or of a portion of a strip or of a bitumen, or of a bitumen base mixture 5, different from said first and/or second bitumen or mixture 3, 3' over at least one of its spaces 2', 2".

This sheet or membrane 1 is characterized in that said at least one strip or strip portion 4 formed from said different bitumen or mixture 5 consists in a layer of this latter used in at least one reinforcement in the shape of a groove or portion of a groove provided by scraping or scratching, in the bitumen layer or bitumen base mixture 3, 3' initially applied on the upper surface 1' or lower surface 1" of said sealing sheet or membrane 1.

Of course, this sheet or membrane 1 is preferably obtained by means of the process described above and by means of the above installation 6.

Finally, the invention also has for its object a sealing system for roofs formed from one or several layers of bituminous sealing sheets or membranes, characterized in that at least the base layer in contact with the support 10 to be covered, is formed of sealing sheets or membranes 1 described above, the zone 4 in the form of a lateral strip comprising on the surface or on the underside a layer of cold self-adhesive bitumen 5 covering or being covered by a zone in the form of a lateral strip of an adjacent sheet or membrane 1.

As shown in FIG. 4 of the accompanying drawings, the sheets or membranes 1 according to the invention could be fixed by mechanical securements 11 along their longitudinal edges, the opposite edge having on its undersurface a strip 4 of self-adhesive bitumen adapted to cover the mechanically secured edges of the sheet or of the laterally adjacent membrane 1.

Such a sealing layer can be quickly put in place without requiring heating means, has a good sealing at the zones that are covered and is fixed securely to the support 10 to be covered, for example of the steel tub type covered with mineral wool.

Of course, the invention is not limited to the embodiments described and shown in the accompanying drawings. Modifications remain possible, particularly as to the construction of the various elements or by the substitution of technical equivalents, without thereby departing from the scope of protection of the invention.

What is claimed is:

1. Process for the production of a bituminous sealing sheet or membrane comprising a strip impregnated and/or coated with at least one bitumen, or at least one bitumen-based mixture, on at least one of its surfaces, and having at least one zone in the form of a strip or portion of a strip of bitumen, or bitumen-based mixture, which is different from said bitumen or bitumen-based mixture previously applied, on at least one of its surfaces, which process comprises:

producing a strip (2) impregnated and/or coated with a first bitumen thickness by applying a first bitumen or bitumen-based mixture (3, 3'), said strip having, on at least one of its surfaces (2', 2"), at least one zone (4) having either no bitumen or a lesser bitumen thickness than the first bitumen thickness by applying a bitumen or bitumen-based mixture (5) different from the first bitumen or bitumen-based mixture;

cooling the bitumens or bitumen-based mixtures to form a resulting sealing sheet or membrane; and after cooling of the bitumens or bitumen-based mixtures, processing the resulting sealing sheet or membrane (1) to a desired form, wherein the application of the first bitumen or bitumen-based mixture is carried out by means of one or several coaters, of the type with a roller or calender with a scraper, applying said first bitumen or bitumen-based mixture only over a portion or portions of the width of said strip (2).

2. Process according to claim 1, characterized in that, the first bitumen or bitumen-based mixture is removed by a scraper or screed (9) located immediately after a coating station, and the thus-removed first bitumen or bitumen-based mixture is pressed against the strip (2), the strip running on or below said scraper or screed (9).

3. Process according to claim 1, characterized in that the one zone (4) consists of a continuous lateral strip forming a longitudinal edge of the final resulting sealing sheet or membrane (1).

4. Process according to claim 1, characterized in that the zone or zones (4) receiving the bitumen or bitumen-based mixture (5) used, consists in one or several strips extending longitudinally with respect to the undersurface (1") of the sealing membrane or sheet (1), and being distributed transversely with fixed or variable spaces between them.

5. Process according to claim 1, characterized in that the thickness of the bitumen or bitumen-based mixture layer (5) used as about equal to the thickness of the layer of bitumen or bitumen-based mixture (3, 3') initially present.

6. Process according to claim 1, characterized in that the thickness of the layer of bitumen or bitumen-based mixture (5) used is different from the thickness of the layer of bitumen or bitumen base mixture (3, 3') initially present.

7. Process according to claim 1, characterized in that the bitumen or bitumen-based mixture (5) that is used consists of bitumen or a bitumen-based mixture that is cold adhesive or self-adhesive, areas receiving said self-adhesive bitumen or bitumen-based mixture (5) being covered before processing with a peelable protective sheet.

8. Process for the production of a bituminous sealing sheet or membrane comprising a strip impregnated and/or coated with at least one bitumen, or at least one bitumen-based mixture, on at least one of its surfaces and having at least one zone in the form of a strip or a portion of a strip of bitumen, or bitumen-based mixture, which is different from said bitumen or mixture previously applied, on at least one of its surfaces, which process comprises:

producing a strip (2) impregnated and/or coated with a first bitumen thickness by applying a first bitumen or bitumen-based mixture (3, 3') to the strip, said strip having, on at least one of its surfaces (2', 2"), at least one zone (4) having either no bitumen or a lesser bitumen thickness than the first bitumen thickness by applying a bitumen or bitumen-based mixture (5) different from the first bitumen or bitumen-based mixture;

cooling the bitumens or bitumen-based mixtures to from a resulting sealing sheet or membrane; and after cooling of the bitumens or bitumen-based mixtures, processing the resulting sealing sheet or membrane (1) to a desired form, wherein the production of the strip (2) having at least one zone comprises, after said strip (2) is applied with said first bitumen or bitumen-based mixture, in one or several applications, over all its surface, removing locally, ova a pre-regulated width and depth, said first bitumen or bitumen-based mixture from at least one of the surfaces (2', 2") of said strip (2), in at least the one zone, said step of removing being before said step of cooling.

9. Process according to claim 8, characterized in that, the removal of the first bitumen or bitumen-based mixture is carried out by a scraper or screed (9) located immediately after a coating station, and the thus-removed bitumen or bitumen-based mixture is pressed against the strip (2), as the strip is running on or below said scraper or screed (9).

10. Process according to claim 8, characterized in that the one zone (4) receiving the consists of a continuous lateral strip forming a longitudinal edge of the final resulting sealing sheet or membrane (1).

11. Process according to claim 8, characterized in that the zone or zones (4) receiving the bitumen or bitumen-based mixture (5) used, consists in one or several strips extending longitudinally with respect to the undersurface (1") of the sealing membrane or sheet (1), and being distributed transversely with fixed or variable spaces between them.

12. Process according to claim 8, characterized in that the thickness of the bitumen or bitumen-based mixture layer (5) used is about equal to the thickness of the layer of bitumen or bitumen-based mixture (3, 3') initially present.

13. Process according to claim 8, characterized in that the thickness of the layer of bitumen or bitumen-based mixture (5) used is different from the thickness of the layer of bitumen or bitumen base mixture (3, 3') initially present.

14. Process according to claim 8, characterized in that the bitumen or bitumen-based mixture (5) that is used consists of bitumen or a bitumen-based mixture that is cold adhesive or self-adhesive, areas receiving said self-adhesive bitumen or bitumen-based mixture (5) being covered before processing with a peelable protective sheet.

* * * * *